US005893351A

United States Patent [19]

Akutagawa et al.

[11] Patent Number: 5,893,351

[45] Date of Patent: Apr. 13, 1999

[54] FUEL SUPPLY DEVICE HAVING SLIP-OUT PREVENTING MEMBER AND METHOD FOR ASSEMBLING THE SAME

[75] Inventors: Masaki Akutagawa, Chiryu; Yukio Sawada, Anjo, both of Japan

[73] Assignee: Denso Corporation, Kariya, Japan

[21] Appl. No.: 08/950,767

[22] Filed: Oct. 15, 1997

[30] Foreign Application Priority Data

Oct. 15, 1996 [JP] Japan ..... 8-272370

[51] Int. Cl.[6] ..... F02M 37/04

[52] U.S. Cl. ..... 123/470; 123/456

[58] Field of Search ..... 123/470, 456, 123/472, 469, 468; 439/378, 376, 379, 130, 76, 77

[56] References Cited

U.S. PATENT DOCUMENTS

| | | | |
|---|---|---|---|
| 4,857,003 | 8/1989 | Hafner et al. . | |
| 4,991,557 | 2/1991 | DeGrace | 123/470 |
| 5,035,224 | 7/1991 | Hornby et al. . | |
| 5,129,834 | 7/1992 | Cranford | 123/470 |
| 5,136,999 | 8/1992 | Bassler | 123/470 |
| 5,209,204 | 5/1993 | Bodenhausen | 123/470 |
| 5,350,314 | 9/1994 | Saba | 123/470 |
| 5,363,825 | 11/1994 | Becker | 123/470 |
| 5,501,195 | 3/1996 | Hall | 123/470 |
| 5,520,151 | 5/1996 | Gras | 123/470 |
| 5,598,842 | 2/1997 | Treusch | 123/470 |
| 5,718,206 | 2/1998 | Sawada | 123/470 |

*Primary Examiner*—Carl S. Miller
*Attorney, Agent, or Firm*—Nixon & Vanderhye P.C.

[57] ABSTRACT

In a fuel supply device for an engine, a clip is fitted in two grooves formed in a fuel injector through its pawls parallel with each other, and fitted with a convex portion formed on a fuel delivery pipe through its window portion. The clip is prevented from slipping out of the injector in an axial direction and the fuel delivery pipe. Even if a wire harness tends to slip out of an electric connector, a sealing member is stopped at a stopper plate of the clip to thereby prevent the wire harness from slipping out.

16 Claims, 4 Drawing Sheets

FUEL SUPPLY DEVICE HAVING SLIP-OUT PREVENTING MEMBER AND METHOD FOR ASSEMBLING THE SAME

BACKGROUND OF THE INVENTION

1. Field of the Invention

The present invention relates to a fuel supply device for supplying fuel to cylinders of an internal combustion engine and a method of assembling the same.

2. Related Art

A fuel supply device for injecting fuel to cylinders of an engine from injectors connected to a fuel delivery pipe is disclosed in U.S. Pat. No. 5,035,224. In this fuel supply device, each electrically-operated fuel injector is prevented from being slipping out of a fuel delivery pipe by a clip for coupling the fuel delivery pipe to the injector. An electric feeder wire (wires) is connected to each injector from the outside of the fuel delivery pipe, and a feeder connector of the feeder wire is connected to a receiving connector provided on the injector to supply electric power to the injector.

However, in this conventional fuel supply device, the receiving connector and the feeder connector are necessary for the injector and a connecting portion of the feeder wire, respectively, thus requiring an increased number of steps of manufacture and high manufacturing cost. Further, it is necessary to connect the feeder wire from injector to injector from an electronic control unit (ECU) as a signal supply source, thus requiring cumbersome wiring work.

Further, there is known a fuel supply device in which an input connector for inputting a signal from an ECU and a feeder connector connected to a receiving connector of an injector are provided on a fuel delivery pipe, and a feeder wire for connecting the input connector with the feeder connector is insert-molded within the fuel delivery pipe to thereby simplify the wiring work. This also requires an increased number of steps of manufacturing the fuel delivery pipe and high manufacturing cost.

SUMMARY OF THE INVENTION

It is an object of the present invention to provide an inexpensive fuel supply device which is simple in construction and prevents a fuel injector from slipping out of a fuel delivery pipe, and a method for assembling the same.

In a fuel supply device according to the present invention, there is provided a slip-out preventing member for preventing a feeder wire from slipping out of an electrically-operated fuel injector. Thereby, the connecting construction between the injector and the feeder wire is simplified, and it is not necessary to form an electric connecting construction in the fuel delivery pipe. Further, the slipping-out of the injector from the fuel delivery pipe is prevented by the slip-out preventing member whereby in the state in which the injector having the feeder wire connected thereto is mounted on the fuel delivery pipe, the fuel supply device can be easily moved.

Preferably, the slip-out preventing member is fitted in the injector at two places of the receiving connector and the injector, that is, on the different circumferences about the axis of the injector to thereby restrict rotation with respect to the injector and the slip-out preventing member.

Preferably, the slip-out preventing member is a clip which has a first fitting portion and a second fitting portion formed in parallel with each other. The first fitting portion and the second fitting portion are fitted while being guided by grooves formed on a receiving connector and the injector, respectively. Therefore, the locating of the slip-out preventing member in the axial direction of the injector can be carried out easily.

More preferably, the slip-out preventing member is fitted with the fuel delivery pipe as well as the injector whereby the fuel delivery pipe is connected to the injector through the slip-out preventing member, thus preventing the injector from slipping out of the fuel delivery pipe.

Still more preferably, the feeder wire is connected to the injector before being assembled in the engine. It is possible to simplify connecting the feeder wire to the injector within a limited engine compartment.

BRIEF DESCRIPTION OF THE DRAWINGS

Other objects, features and advantages of the invention will be made more apparent by the following detailed description with reference to the accompanying drawings, in which.

DETAILED DESCRIPTION OF THE PREFERRED EMBODIMENT

A preferred embodiment of the present invention will be described in detail with reference to the drawings.

Figure 1:
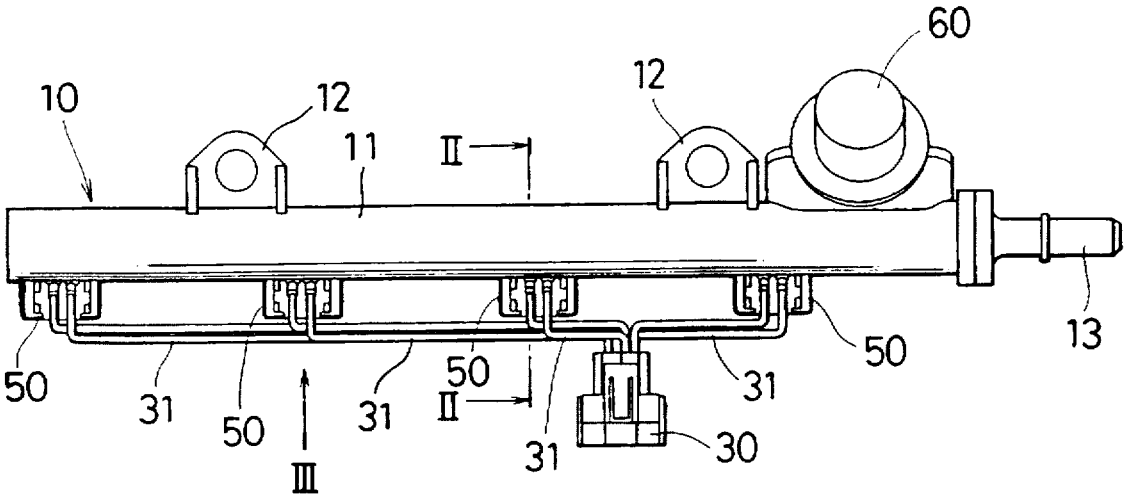
FIG. 1 is a plan view showing a fuel supply device according to an embodiment of the present invention.
Figure 2:
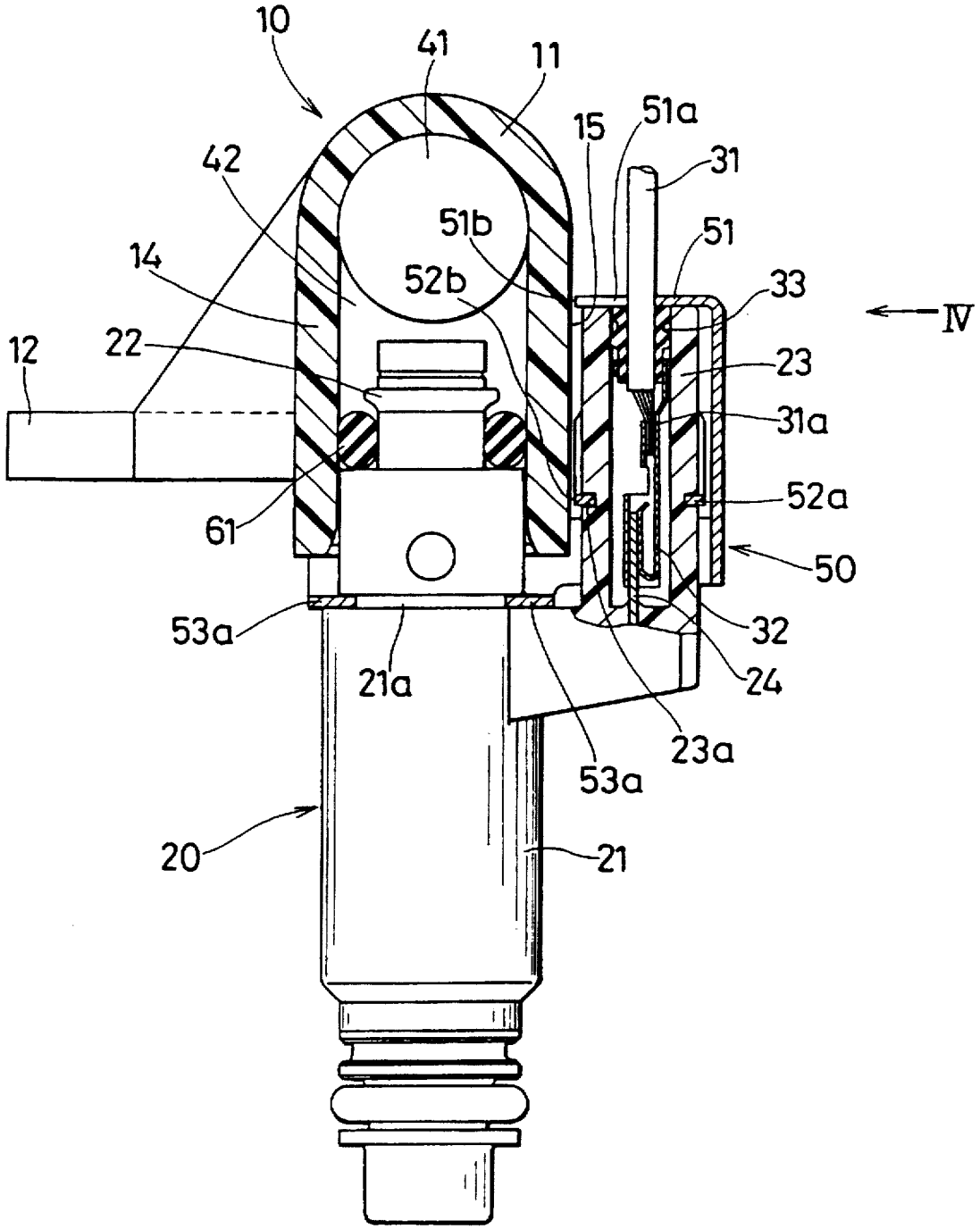
FIG. 2 is a sectional view of the embodiment taken on line II—II in FIG. 1.
Figure 4:
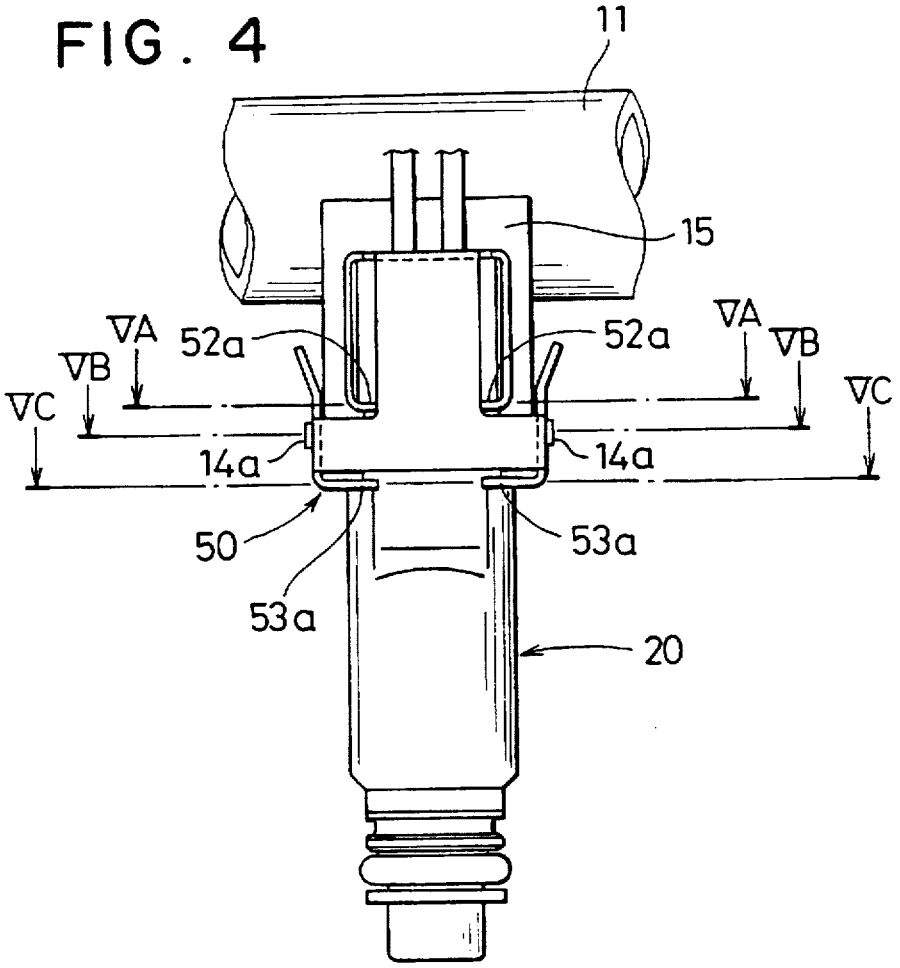
FIG. 4 is a view taken in a direction IV in FIG. 2.

As shown in FIGS. 1, 2 and 4, a fuel delivery pipe 10 comprises a cylindrical portion 11 as a fuel introducing portion and a plurality of fuel supply ports 14. The cylindrical portion 11 is molded cylindrically with its one end (left in FIG. 1) being closed. The fuel delivery pipe 10 is secured to an engine (not shown) by means of bolts or the like by a bracket portion 12 provided on the cylindrical portion 11. A supply pipe connecting portion 13 is provided on the other end of the cylindrical portion 11 (right in FIG. 1), and the supply pipe connecting portion 13 and a fuel pump (not shown) are connected by a fuel supply pipe. Fuel supplied from the fuel pump is introduced into a supply passage 41 within the cylindrical portion 11 through the fuel supply pipe and the supply pipe connecting portion 13. Further, a well known fuel pulsation damper 60 is mounted on the cylindrical portion 11 to suppress fuel pulsation within the cylindrical portion 11.

As shown in FIG. 2, an injector 20 for injecting fuel into an intake manifold of each cylinder of the engine is inserted into a fuel supply port 14, and fuel distributed to the delivery passage 42 formed within each fuel supply port 14 from the supply passage 41 is supplied to each fuel injector 20 which is operated electrically. An inner wall of the fuel supply port 14 and an outer wall of a fuel inlet 22 formed on the top end of an injector body 21 are sealed by an O-ring 61.

An input connector 30 (FIG. 1) is provided to connect a signal cable from an ECU as an injector control signal supply source (not shown) with a wire harness 31 as an electric feeder wire (a pair of wires). A fuel injection signal is delivered from the input connector 30 to the injector 20 through the wire harness 31.

An extreme end of an electric wire 31*a* of the wire harness 31 and a sealing member 33 are secured by caulking by a feeder terminal 32. The sealing member 33 is formed cylindrically. The outside diameter of the sealing member 33 is set to be slightly larger than the diameter of two openings of a power receiving connector 23 into which the wire harness 31 is inserted in the state before the wire harness 31 is inserted into a receiving connector 23 of the injector 20.

In the state shown in FIG. 2 in which the fuel delivery pipe 10, the injector 20 and the wire harness 31 are assembled together, a receiving terminal 24 of the injector 20 and the feeder terminal 32 of the wire harness 31 are electrically connected within the receiving connector 23. The sealing member 33 is compressed in a diametral direction between the receiving connector 23 and the wire harness 31 by an elastic force to prevent dust and water from entering an electric connecting portion of the terminals within the receiving connector 23.

Figure 5A:
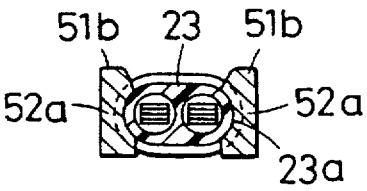
FIGS. 5A through 5C are sectional views taken on lines VA—VA, VB—VB and VC—VC in FIG. 4, respectively.
Figure 5B:
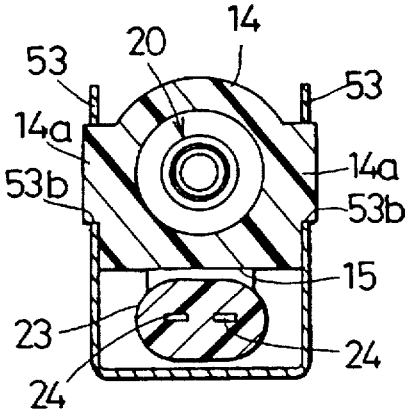

The receiving connector 23 is formed substantially in parallel with the axis of the injector 20 integrally with the injector body 21 on the side of the injector body 21. The receiving connector 23 is formed to be oval in section as shown in FIG. 5B, and the surface thereof opposite to the fuel delivery pipe 10 is substantially planar. As shown in FIG. 2, the receiving terminal 24 is embedded substantially in parallel with the axis of the injector 20 within the receiving connector 23. Two openings are provided at one end of the receiving connector 23. The feeder terminal 32 electrically coupled to the wire harness 31 is inserted from each opening of the receiving connector 23, and the receiving terminal 24 and the feeder terminal 32 are electrically connected within the receiving connector 23.

Next, the construction of a clip 50 as a slip-out preventing member will be explained. The clip 50 is provided to prevent the wire harness 31 from slipping out of the receiving connector 23 and to prevent the injector 20 from slipping out of the fuel delivery pipe 10 by coupling the fuel delivery pipe 10 to the injector 20.

Figure 3:
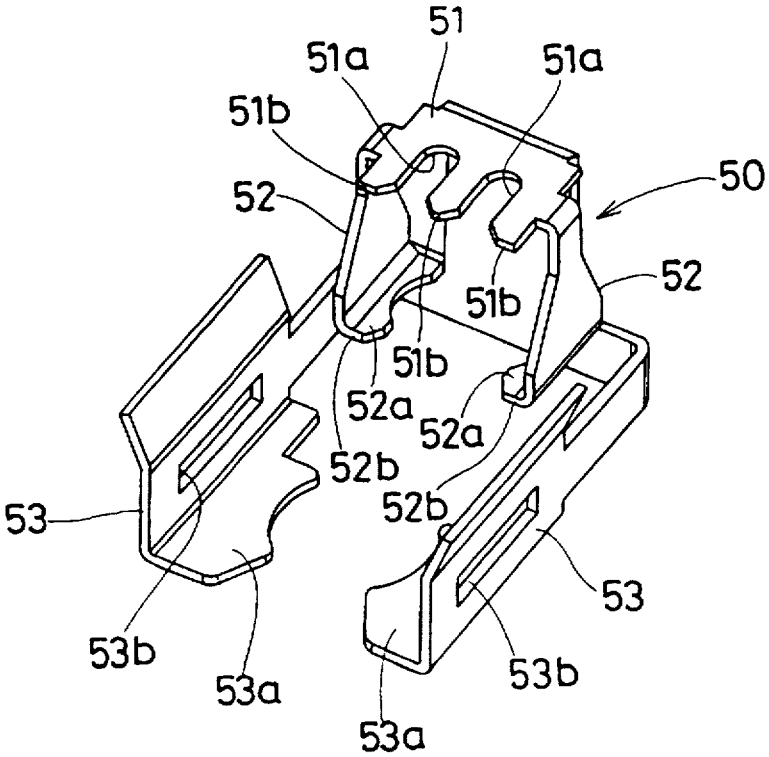
FIG. 3 is a perspective view showing a clip used in the embodiment.

As shown in FIG. 3 in detail, the clip 50 has a stopper plate 51 as a sealing portion, a pair of arms 52 and a pair of arms 53. The stopper plate 51 as a sealing portion, the arms 52 and the arms 53 are formed parallel with each other. In the state shown in FIG. 2, they are orthogonal to the axis of the injector 20. An arcuate cut 51*a* formed in the stopper plate 51 is larger in diameter than the wire harness 31 and smaller in width than the diameter of each opening of the receiving connector 23. Accordingly, the wire harness 31 can pass through the cut 51*a*, but the sealing member 33 secured to the wire harness 31 and fitted in the receiving connector 23 is stopped at the stopper plate 51 in the slipping-out direction from the receiving connector 23.

The arms 52 are formed at respective ends with pawls 52*a* as a first fitting portion so as to sandwich the receiving connector 23 therebetween parallel with the receiving connector 23 from both sides of the stopper plate 51 and extend toward the receiving connector 23. The inner periphery of the pawl 52*a* is formed arcuately. The inside diameter of the pair of opposed pawls 52*a* is set to be slightly smaller than the outside diameter of an annular groove 23*a* as a first stopper portion formed in the outer periphery of the receiving connector 23. Accordingly, as shown in FIG. 5A, in the state in which the pawls 52*a* are fitted in the grooves 23*a*, the pawls 52*a* hold the receiving connector 23 by the elastic force of the arm 52.

Figure 5C:
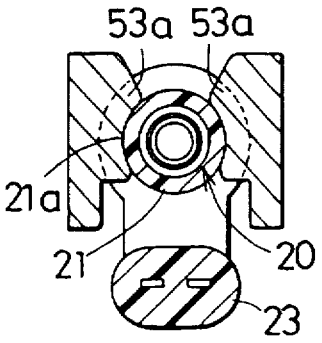

As shown in FIG. 3, the arms 53 are formed at respective ends with pawls 53*a* as a second fitting portion which extend so as to sandwich the injector body 21 therebetween from the bottom of the arm 52 and extend toward the injector body 21. The inner periphery of the pawl 53*a* is formed arcuately, and the inside diameter of a pair of opposed pawls 53 is set to be slightly smaller than the outside diameter of an annular groove 21*a* as a second stopper portion formed in the outer periphery of the injector body 21. Accordingly, as shown in FIG. 5C, in the state in which the pawls 53*a* are fitted in the groove 21*a*, the pawls 53*a* hold the injector body 21 by the elastic force of the arms 53.

As shown in FIG. 3, a window portion 53*b* as a third fitting portion is formed so as to oppose each arm 53, and fitted with a rectangular convex or protruding portion 14*a* as a third stopper portion 3 formed in the fuel supply port 14 as shown in FIG. 5B.

The pawls 52*a*, 53*a* parallel with each other of the clip 50 are fitted in two grooves 23*a*, 21*a* formed in the injector 20. Accordingly, the sealing member 33 is stopped by the stopper plate 51 when the wire harness 31 tends to slip out of the feeder connector 23, so that the clip 50 receives the force in the direction in which the wire harness 31 slips out. Even so, the wire harness 31 is prevented from slipping out of the receiving connector 23 by the fitting between the pawl 52*a* and the groove 23*a* and the fitting between the pawl 53*a* and the groove 21*a*.

When the injector 20 tends to slip out of the fuel delivery pipe 10, the axial force of the injector 20 acts on the fitting portion between the fuel delivery pipe 10 and the clip 50 and the fitting portion between the injector 20 and the clip 50. The slipping-out of the clip 50 from the fuel delivery pipe 10 is restricted by the fitting between the convex portion 14*a* and the window portion 53*b*, and the slipping-out of the injector 20 from the clip 50 is restricted by the fitting between the pawls 52*a*, 53*a* and the grooves 23*a*, 21*a*. Accordingly, the injector 20 is prevented from slipping out of the fuel delivery pipe 10.

Since the fitting position between the pawls 52*a*, 53*a* of the clip 50 and the grooves 23*a*, 21*a* of the injector 20 are on two different circumferences around the axis of the injector 20, the injector 20 and the clip 50 are restricted from relative rotation. In the state shown in FIG. 2, a clearance formed between the opposed surface 15 of the fuel supply port 14 and the ends 51*b*, 52*b* of the clip 50 is small. Even if the clip 50 and the receiving connector 23 tend to rotate around the axis of the injector 20 with respect to the fuel delivery pipe 10, the clip 50 is stopped at the opposed surface 15 whereby the plane-like opposed surface 15 extends within a rotational locus to restrict rotation of the injector 20 with respect to the fuel delivery pipe 10. The opposed surface 15 may be placed in contact with the ends 51*b*, 52*b* of the clip 50.

The above fuel supply device may be assembled in the following order.

Figure 6A:
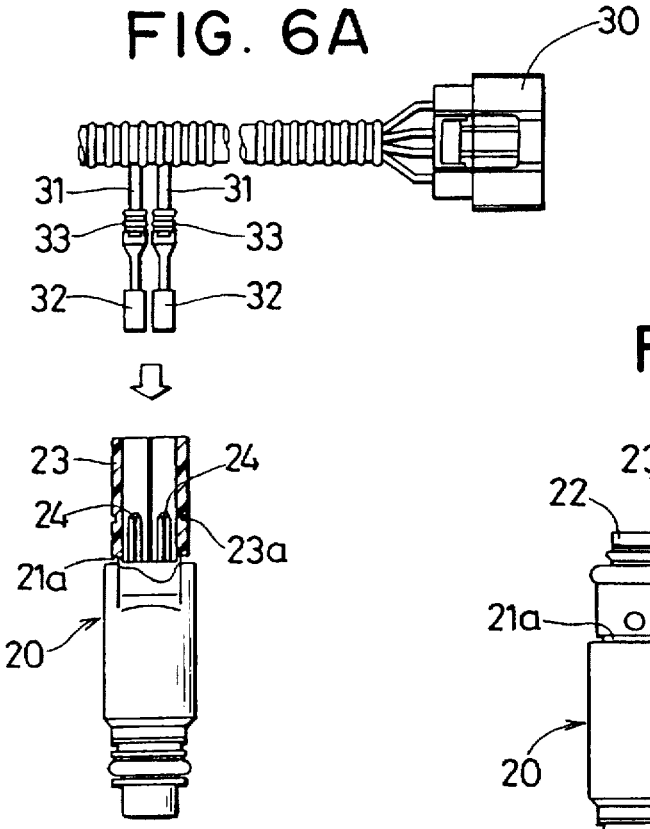
FIGS. 6A through 6D are plan views showing the procedure for assembling the fuel supply device according to the embodiment.

(1) The wire harness 31 corresponding to each injector 20 is inserted into the receiving connector 23 integral with the injector 20, and the feeder terminal 32 is electrically connected with the receiving terminal 24 as shown in FIG. 6A. At this time, the sealing member 33 is fitted in the receiving connector 23.

Figure 6B:
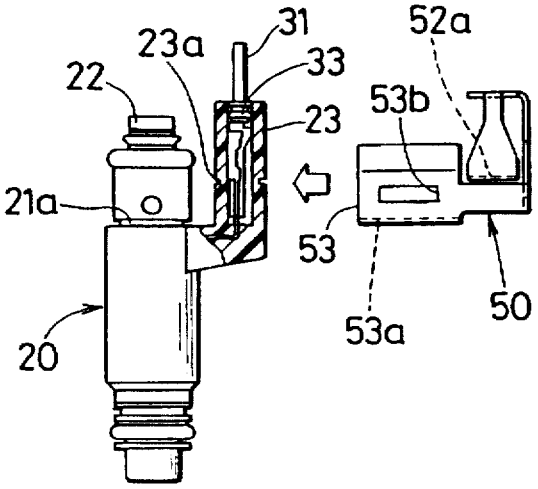

(2) Then, as shown in FIG. 6B, the clip 50 is fitted with the injector 20 in a direction orthogonal to an axial direction of the injector 20, that is, in a direction orthogonal to a coupling direction between the fuel delivery pipe 10 and the injector 20. At this time, since the pawls 53*a*, 52*a* are fitted while being guided by the grooves 21*a*, 23*a*, the clip 50 in the axial direction of the injector 20 is easily located.

The pawls 53*a*, 52*a* are fitted in the grooves 21*a*, 23*a* to thereby restrict the movement of the clip 50 in the axial direction of the injector 20. Therefore, even if the wire harness 31 tends to slip out of the receiving connector 23, the sealing member 33 is stopped by the stopper plate 51. The clip 50 is fitted in two places of the injector 20, whereby the relative rotation between the injector 20 and the clip 50 is restricted.

Figure 6C:
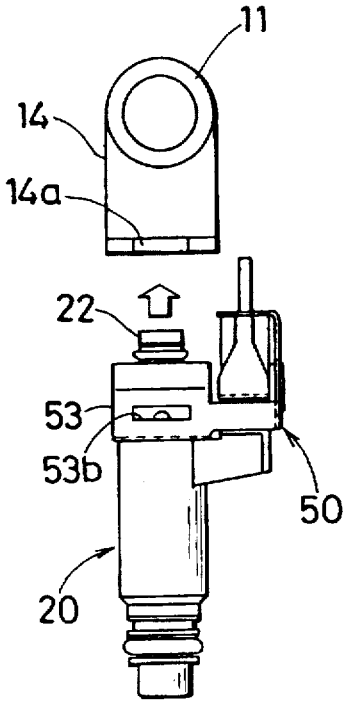

(3) Further, as shown in FIG. 6C, the fuel inlet 22 of the injector 20 is inserted into the fuel supply port 14 of the fuel delivery pipe 10.

Figure 6D:
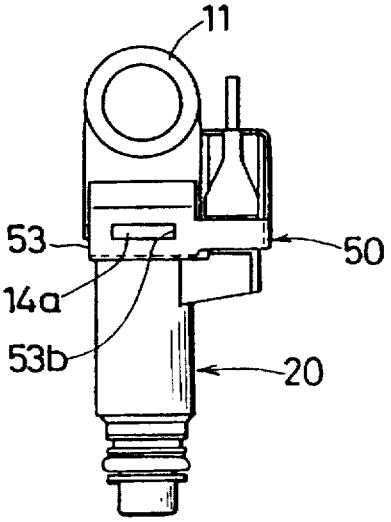

(4) Finally, as shown in FIG. 6D, the window portion 53*b* of the clip 50 is fitted into the convex portion 14*a* of the fuel supply port 14 whereby the injector 20 in the axial direction with respect to the fuel delivery pipe 10 is located.

In the state in which the window portion 53*b* is fitted with the convex portion 14*a*, the clip 50 does not slip out of the fuel delivery pipe 10 unless the arm 53 is spread, and the movement of the clip 50 with respect to the fuel delivery pipe 10 is restricted. The window portion 53*b* is fitted with the convex portion 14*a*, and the pawls 52*a*, 53*a* are fitted in the grooves 23*a*, 21*a*, respectively, in the aforementioned step (2) to thereby prevent the injector 20 from being disengaged from the fuel delivery pipe 10.

Further, since the clearance formed between the opposed surface 15 and the ends 51*b*, 52*b* of the clip 50 is set to be small, even if the injector 20 is to be rotated, the ends 51*b*, 52*b* of the receiving connector 23, the rotation of the injector 20 with respect to the fuel delivery pipe 10 and the clip 50 are stopped at the opposed surface 15.

In the embodiment of the present invention described above, by the single clip 50, the slipping-out of the wire harness 31 for feeding electric power to the injector 20 is prevented, and the slipping-out of the injector 20 from the fuel delivery pipe 10 is prevented. Accordingly, a feeder connector need not be provided on the feeder terminal side, and a connector for electric connection need not be formed on the fuel delivery pipe 10. Therefore, the connection between the injector 20 and the wire harness 31 is simplified, and the number of parts is reduced so that the number of steps of manufacture and the manufacturing cost is reduced.

Further, since standard parts other than those integrated are available for parts, for example, the input connector 30, the wire harness 31, the feeder terminal 32, the sealing member 33, parts need not be manufactured newly, and the manufacturing cost can be further reduced.

Moreover, a plurality of injectors 20 having the wire harness 31 connected thereto respectively can be mounted on the engine in the state in which the injectors 20 are assembled to the fuel delivery pipe 10. The assembling work within the engine compartment in which the space is limited is facilitated.

Further, in the present embodiment, since the feeder terminals of the plurality of wire harnesses 31 are collected in the single input connector 30, the electric connection with ECU can be done at one time. Accordingly, the number of assembling steps can be reduced, and the assembling work within the engine room for which the space is restricted is facilitated.

Further, in the present embodiment, the receiving connector 23 and the opposed portions 51*b*, 52*b* of the clip 50 are stopped at the opposed surface 15 whereby the rotation of the injector 20 with respect to the fuel delivery pipe 10 can be prevented. Accordingly, the direction of injecting fuel injected into the intake manifold of each cylinder from the injector 20 is constant, and fuel can be injected at a desired position toward an intake valve of the engine.

While, in the present embodiment, the clip 50 as a slip-out preventing member is fitted with the injector 20 at two places, it is to be noted that the slip-out preventing member 50 may be fitted with the injector 20 at only one place, while still preventing the slipping-out of the feeder wire 31*a* from the receiving connector 23 and the slipping-out of the injector 20 from the fuel delivery pipe 10.

Further, the fitting between the slip-out preventing member 50 and the injector 20 includes not only the fitting between the pawl 52*a* (the first fitting portion), and 53*a* (the second fitting portion), and the groove 23*a* (the first stopper portion), 21*a* (the second stopper portion) illustrated in the present embodiment but also, for example, the fitting form between the window portion 53*b* and the convex portion 14*a*. In this case, it is not necessary that the first fitting portion and the second fitting portion should be in parallel with each other.

Further, the receiving connector 23 of the injector 20 need not be formed parallel with the axis of the injector 20. The receiving connector 23 may be extended diagonally from the axis of the injector 20.

Furthermore, the stopper plate 51 and the arm 52 are formed closer to the opposed surface 15 than the receiving connector 23 so that, when the receiving connector 23 rotates around the axis of the injector 20, the clip 50 comes into contact with the plane-like opposed surface 15. It is to be noted that the stopper plate 51 and the arms 52 may be formed only at a position away from the opposed surface 15 than the receiving connector 23. In this case, the opposed surface 15 of the fuel supply port 14 opposite to the receiving connector 23 is formed to be planar. In the state shown in FIG. 5B in which the device is assembled, the plane-like opposed surface 15 is formed to extend in a rotational locus of the receiving connector 23 with respect to the fuel delivery pipe 10, and therefore, when the receiving connector 23 tends to rotate, it is stopped by the plane-like opposed surface 15 whereby the rotation of the injector 20 is restricted. The opposed surface 15 may be constructed in contact with the receiving connector 23.

The present invention should not be limited to the disclosed embodiment and its modifications but may be changed and altered further without departing from the spirit of the invention.

What is claimed is:

1. A fuel injection supply device for attachment to between a fuel delivery pipe and an internal combustion engine, said device comprising:

a wiring harness of plural wires formed to be separate from said fuel delivery pipe;

a fuel injector having electrical connections to an electrical connector which is, in turn, connectable to respective electrical wires and terminals of said wiring harness; and a single snap-on clip having at least three integral locating structures for relatively affixing together the fuel injector, the fuel delivery pipe and said wiring harness:

a first locating structure being engageable with said electrical connector and said respective wires from the wiring harness to prevent inadvertent disconnection during installation;

a second locating structure being engageable with said fuel injector; and a third locating structure being engageable with said fuel delivery pipe.

2. A fuel supply device for an engine, said device comprising:

a fuel delivery pipe;

an electrically-operated fuel injector connectable to said fuel delivery pipe to inject fuel introduced from said fuel delivery pipe to said engine;

a feeder wire connectable to said injector, said feeder wire passing on the exterior of said fuel delivery pipe and movable relative to said pipe; and a slip-out preventing member for (a) preventing said feeder wire from slipping out of said injector and (b) simultaneously preventing said injector from slipping out of said fuel delivery pipe.

3. The fuel supply device of claim 2, further comprising:

a receiving connector attached to said injector;

a receiving terminal provided within said receiving connector; and a sealing member secured to said feeder wire and fitted in said receiving connector to prevent entry of foreign matter into said receiving connector, wherein said slip-out preventing member has a stopper portion for preventing said sealing member from slipping out of said receiving connector.

4. The fuel supply device of claim 3, wherein:

said slip-out preventing member has a first fitting portion to be fitted in a first stopper portion provided on said receiving connector, and said first fitting portion is stopped at said first stopper portion in a direction in which said feeder wire is slipped out of said receiving connector.

5. The fuel supply device of claim 4, wherein:

said slip-out preventing member has a second fitting portion around the axis of said injector at a position different from said first fitting portion, and said second fitting portion is to be fitted in a second stopper portion provided on said injector.

6. The fuel supply device of claim 5, wherein:

said first fitting portion and said second fitting portion are formed in parallel with each other, and said first stopper portion and said second stopper portion comprise grooves for guiding said first fitting portion and said second fitting portion in a direction orthogonal to a coupling direction between said injector and said fuel delivery pipe.

7. The fuel supply device of claim 5, wherein:

said slip-out preventing member has a third fitting portion to be fitted with a third stopper portion provided on said fuel delivery pipe.

8. The fuel supply device of claim 2, wherein an outer surface of said delivery pipe opposing said slip-out preventing member is formed to be substantially planar to restrict rotation of said injector.

9. The fuel supply device of claim 8, wherein:

said outer surface of said delivery pipe is separated from said slip-out preventing member by a predetermined clearance.

10. The fuel supply device of claim 3, wherein:

said feeder wire is connected to an input connector at an end opposite its feeder terminal.

11. A method for assembling a fuel supply device including an electrical feeder wire fixedly connected to a feeder terminal which is in turn, removably connected to a receiving terminal of a fuel injector within a slip-out preventing member also coupling said injector to a fuel delivery pipe, said method comprising the steps of:

(a) connecting said feeder terminal of said feeder wire to said receiving terminal of said injector;

(b) thereafter mounting said slip-out preventing member to said injector; and (c) thereafter coupling said injector to said fuel delivery pipe.

12. A fuel supply device for an engine, said device comprising:

a fuel delivery pipe extending longitudinally;

an electrically-operated fuel injector fitted into said fuel delivery pipe orthogonally to the fuel delivery pipe, said injector having a power receiving connector;

a feeder wire which is separate from said fuel delivery pipe and which has one end disposed in said power receiving connector; and a single holding member for holding said delivery pipe, said fuel injector and said feeder wire in predetermined positions relative to each other.

13. The fuel supply device of claim 12, wherein:

said holding member has a stopper plate for covering said power receiving connector thereby to restrict detachment of said one end of the feeder wire from said power receiving connector, said stopper plate being formed with an arcuate cut through which said feeder wire passes.

14. The fuel supply device of claim 13, further comprising:

a sealing member fixed to said feeder wire and disposed within said power receiving connector, said sealing member being sized to be larger than said arcuate cut.

15. The fuel supply device of claim 12, wherein the holding member has:

a wire engagement part engaged with said feeder wire;

a pipe engagement part extending integrally and in parallel with said wire engagement part and engaged with said fuel delivery pipe; and an injector engagement part extending integrally and in parallel with said wire engagement part and engaged with said fuel injector.

16. The fuel supply device of claim 15, wherein:

said pipe engagement part and said injector engagement part are longer than said wire engagement part.

* * * * *